US006578821B2

(12) United States Patent
Lasaroff et al.

(10) Patent No.: US 6,578,821 B2
(45) Date of Patent: Jun. 17, 2003

(54) RESCUE DEVICE WITH AN ADJUSTABLE ARM LENGTH

(75) Inventors: Christoph Lasaroff, Herzogenaurach (DE); Heinz Heller, Erlangen (DE)

(73) Assignee: Lukas Hydraulik GmbH & Co., KG, Erlangen (DE)

( * ) Notice: Subject to any disclaimer, the term of this patent is extended or adjusted under 35 U.S.C. 154(b) by 0 days.

(21) Appl. No.: 10/110,486

(22) PCT Filed: Sep. 28, 2001

(86) PCT No.: PCT/DE01/03744

§ 371 (c)(1),
(2), (4) Date: Apr. 10, 2002

(87) PCT Pub. No.: WO02/34336

PCT Pub. Date: May 2, 2002

(65) Prior Publication Data

US 2002/0153515 A1 Oct. 24, 2002

(30) Foreign Application Priority Data

Oct. 27, 2000 (DE) ..... 100 53 504

(51) Int. Cl.[7] ..... B66F 3/24

(52) U.S. Cl. ..... 254/93 R; 254/93 H; 72/392; 72/452; 72/705

(58) Field of Search ..... 254/18, 93 R, 254/93 H, 93 HP, 104, 124; 72/392, 452, 452.1, 705, 478, 479, 480, 342; 74/104, 107; 29/252, 239, 253; 81/302, 349, 383.5

(56) References Cited

U.S. PATENT DOCUMENTS

| | | | | | |
|---|---|---|---|---|---|
| 4,333,330 | A | | 6/1982 | Porter | |
| 4,522,054 | A | * | 6/1985 | Wilson | 72/392 |
| 4,531,289 | A | * | 7/1985 | Brick | 30/134 |
| 4,973,028 | A | | 11/1990 | Linster | |
| 5,215,288 | A | * | 6/1993 | Lyon | 254/133 A |
| 5,622,353 | A | | 4/1997 | Painter et al. | |
| 5,915,672 | A | * | 6/1999 | Dickey | 254/133 R |
| 5,956,992 | A | | 9/1999 | Patton | |
| 6,272,900 | B1 | * | 8/2001 | Kobel | 72/392 |
| 6,389,870 | B1 | * | 5/2002 | Vigil | 72/392 |

FOREIGN PATENT DOCUMENTS

| | | |
|---|---|---|
| DE | 7615193 | 10/1976 |
| WO | WO 00/59578 | 10/2000 |

* cited by examiner

*Primary Examiner*—Joseph J. Hail, III
*Assistant Examiner*—Daniel Shanley
(74) *Attorney, Agent, or Firm*—Merchant & Gould, P.C.

(57) ABSTRACT

The invention relates to a rescue apparatus 1 with two tool halves 4, 5 that are arranged swingably on a head component 2, which tool halves in each case display a working tip 6, at least one working tip 6 being attached to the tool half 4, 5 so as to be longitudinally displaceable.

16 Claims, 4 Drawing Sheets

RESCUE DEVICE WITH AN ADJUSTABLE ARM LENGTH

Figure 1:
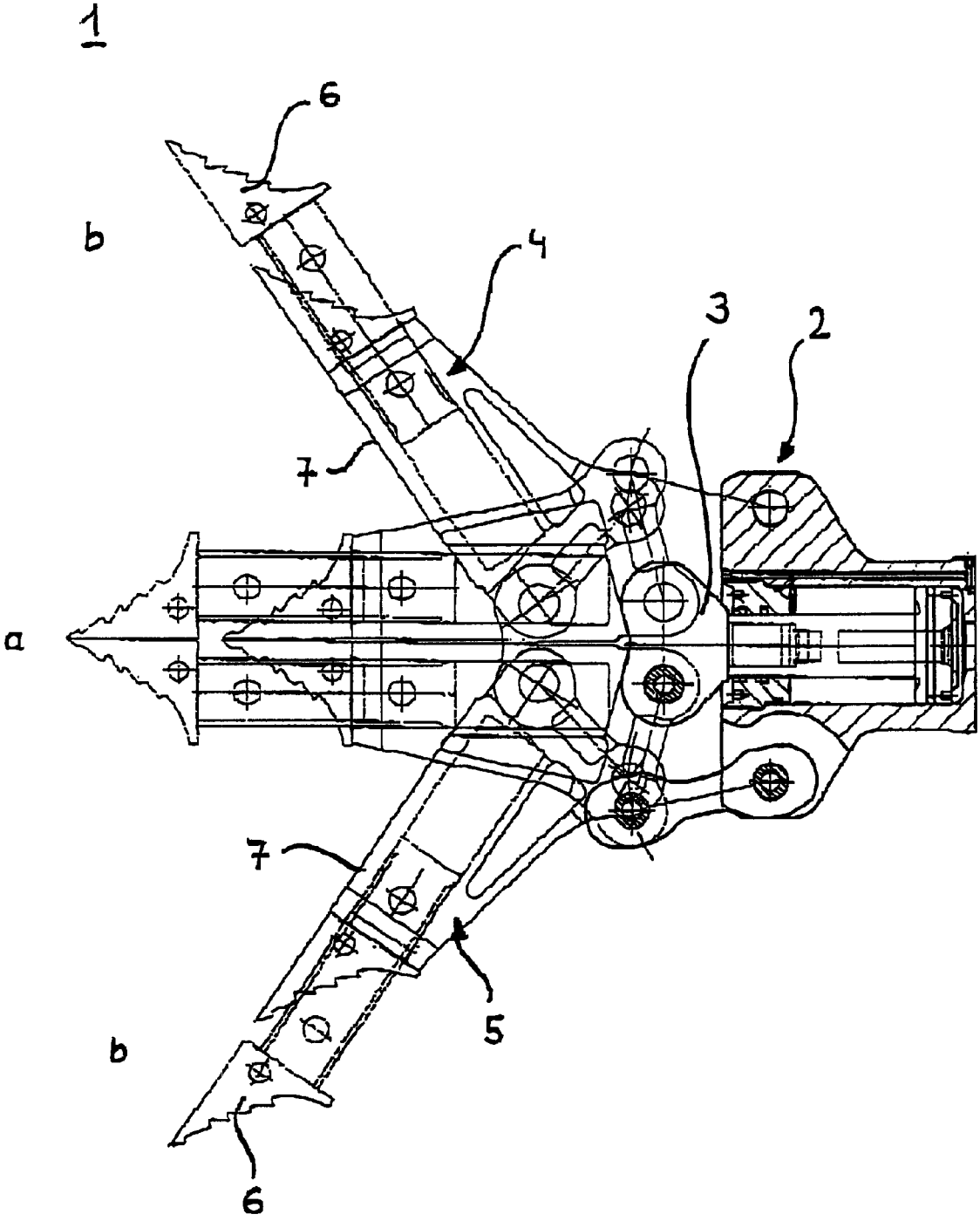

The present invention relates to a rescue apparatus with the additional features of the precharacterizing section of patent claim 1.

The portable rescue apparatuses known hitherto have consisted of, for example, spreading tools or combined cutting/spreading tools that serve, for example, to open a vehicle having been in an accident and to rescue the persons inside the vehicle. Such a rescue apparatus has tool halves arranged in a pivoting manner on a head component, which tool halves display in each case an working tip. According to the particular application, different opening widths of the tool halves are required. Thus, for example, in the spreading open of a jammed door or in the displacement of seats, large spread openings and only relatively small forces are to be used. In contrast, for example, in the tearing open of a door gap in order to expose the hinges, large forces and only small opening widths are necessary.

Different apparatuses are used for these different applications, which involves the disadvantage that these apparatuses must always be available on the spot. This consideration, however, results in a high storage-space requirement, for example in a fire engine, as well as the necessity of always carrying along these apparatuses.

Also known is the attachment of different-length, exchangeable arms to an apparatus. However, this has the disadvantage that the entire set of arms must always be carried along to the application site. Moreover, an exchanging of the arms claims too much time during emergency action, especially when the hinging function is also exchanged. This consumption of time can, however, prove to be extremely unfavorable, especially in the case of a rescue operation that must be carried out quickly.

Thus, the object of the invention is to develop a rescue apparatus with the features of the precharacterizing section of patent claim 1 such that a quick changing of the opening width can be carried out.

This object is achieved through the collective teaching of patent claim 1. Advantageous further developments of the rescue device result from the dependent claims 2–16.

According to the invention, at least one working tip of the rescue apparatus is attached to the respective tool half in longitudinally displaceable manner. Through this possibility of changing the distance of the working tip from the head component or from a coupling element arranged on the latter, the opening width in a swinging movement of the tool halves is consequently also changeable. With the alteration of the opening width, the lever arm also changes, so that different forces can be applied according to the positioning of the working tip. Through the longitudinal displaceability of the working tip, a quick and simple changing of the opening width and of the force necessary for the particular application are possible. No additional replacement parts need be carried along in order to adapt the rescue apparatus to the requirements of each case. Moreover, the compactness of the rescue apparatus as a portable unit is maintained. Preferably, the working tip on each tool half is attached in a longitudinally displaceable manner, so that the optimal opening width can be set and a uniform distribution of force on the two tool halves can be ensured.

For the longitudinal displacement of the working tip, the tool half can include a holding part, at which a guide part, connected to the working tip, is arranged so as to be longitudinally displaceable. Through this two-part structure of the tool half, a reliable longitudinal displaceability of the working tip is ensured. In this context, the guide piece can be fixable to the holding part in at least two positions, so that the arm length set in each case is maintained even in presence of strong force effects, and, for example, the spreading process can be carried out reliably and quickly.

The holding part can display a tunnel inside which the guide part is longitudinally displaceable. By means of the tunnel, first, a reliable opening function of the tool halves is ensured even in the case of an extended tool arm, since the tunnel still produces a secure connection of the holding part and the guide part even when the guide part is pulled out. Second, the tunnel offers protection from external influences, e.g. from contamination or mechanical effects, so that the longitudinal displacing of the guide part is always quick and easy, and can be performed to the desired pull-out length without jamming. Of course, there also exists the possibility that the guide part display a tunnel, in which the holding part is longitudinally displaceable.

The fixing of the guide part to the holding part in a particular position can occur by means of at least one securing bolt, which connects the two parts. Here, the securing bolt can, in the inserted state, penetrate a bore in the holding part as well as a bore arranged directly thereunder in the guide part. The fixing by means of the securing bore can be carried out quickly and easily and, moreover, represents a cost-effect possibility for the reliable fixing of the arm length.

Advantageously, the securing bolt can, in the inserted state, end flush with the surface of the guide part and/or the holding part, so that it is not a hindrance during operation.

In order to ensure that the securing bolt is held steady when in the inserted state and cannot inadvertently fall out, the securing bolt can display a laterally arranged recess, into which penetrates a spring-loaded projection arranged on the holding part or on the guide part. Thus, to fix the arm length of the respective tool half it is only necessary to bring the guide piece into the desired position, so that the bores for the securing bolt in the holding part and in the guide piece lie one atop the other. The only remaining step is to insert the securing bolt, the latter requiring no additional locking. The spring-loaded projection can be advantageously designed as a sphere, so that it glides easily into the recess in the securing bolt. By means of the spherical or spherical-segment projection it is also possible to quickly release the securing bolt again if necessary, since the projection can easily glide again out of the recess when the bolt is pulled in the axial direction.

In order to ensure a reliable clicking into place of the spherical projection, the recess can be formed as a semicircle. The recess advantageously extends around the entire periphery of the securing bolt, so that the latter engages the projection in each inserted position.

In order to make the securing bolt always ready for use during operation, it can be fastened to the holding part or to the head component by means of a flexible connecting part, e.g. a chain. The flexible connecting part ensures that the securing bolt is introduced into the bores in the holding part and in the guide part at different distances from the point of attachment of the connecting part. The securing bolt is thereby always protected from loss and is always ready for use.

To increase the stability of the tool arm during the longitudinal displacement, the guide piece can display reinforced outer edges. Advantageously, the tunnel can display grooves extending in the longitudinal direction of the latter, in which grooves these outer edges are guided.

The working tip can, for example, have a saw-tooth shaped outer profile, which in particular displays the barbs, for example, for wedging into the vehicle-door gap, which barbs are extremely advantageous in the spreading open of the vehicle door. The working tip can, however, also be configured for other functions and display, for example, a cutting edge, so that the rescue apparatus can also be used as a cutting apparatus. The rescue apparatus with its longitudinally displaceable arm tips can therefore be used as a spreading apparatus and/or as a cutting apparatus and/or as a tractive apparatus.

Figure 2:
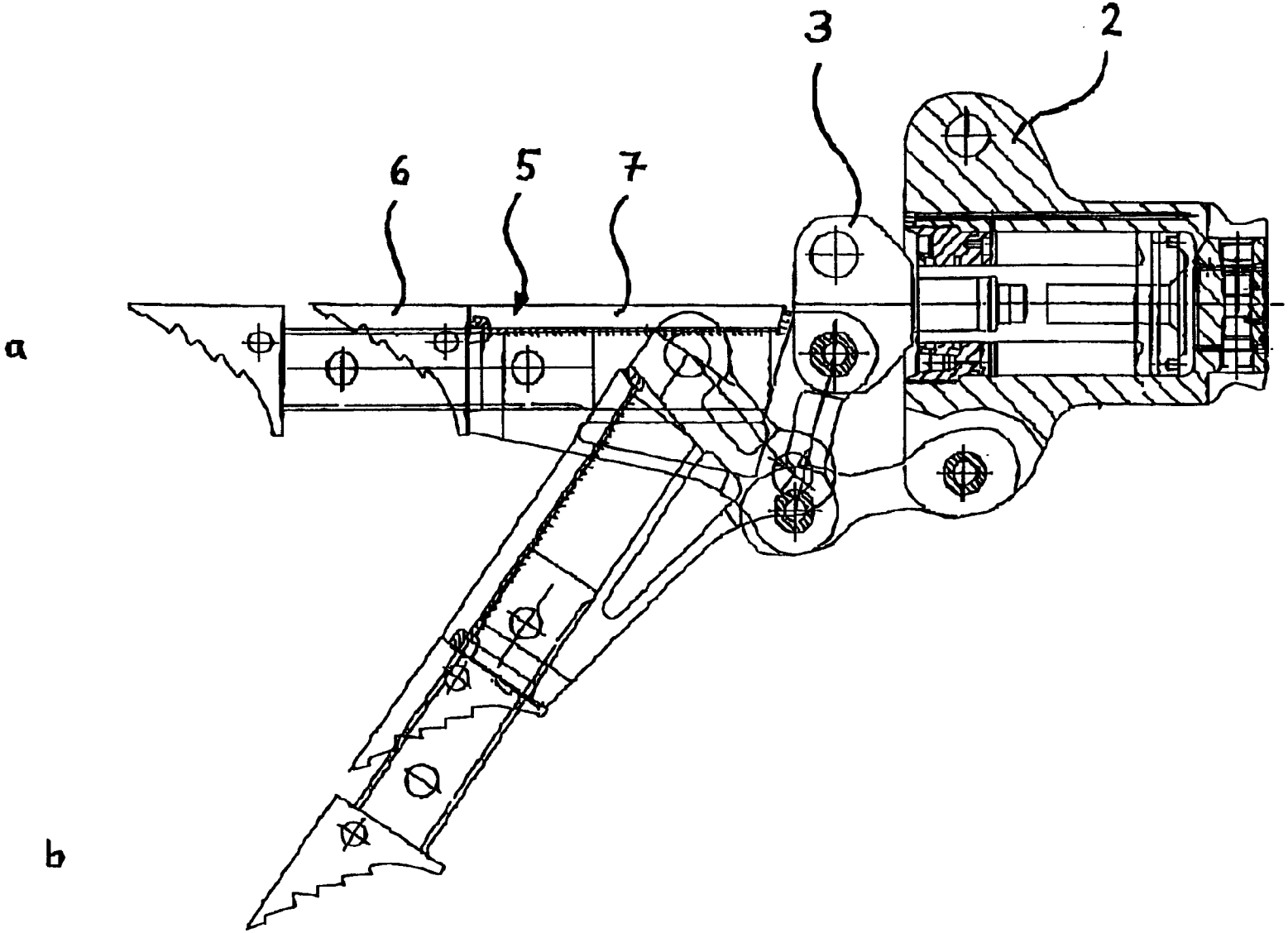
Figure 3:
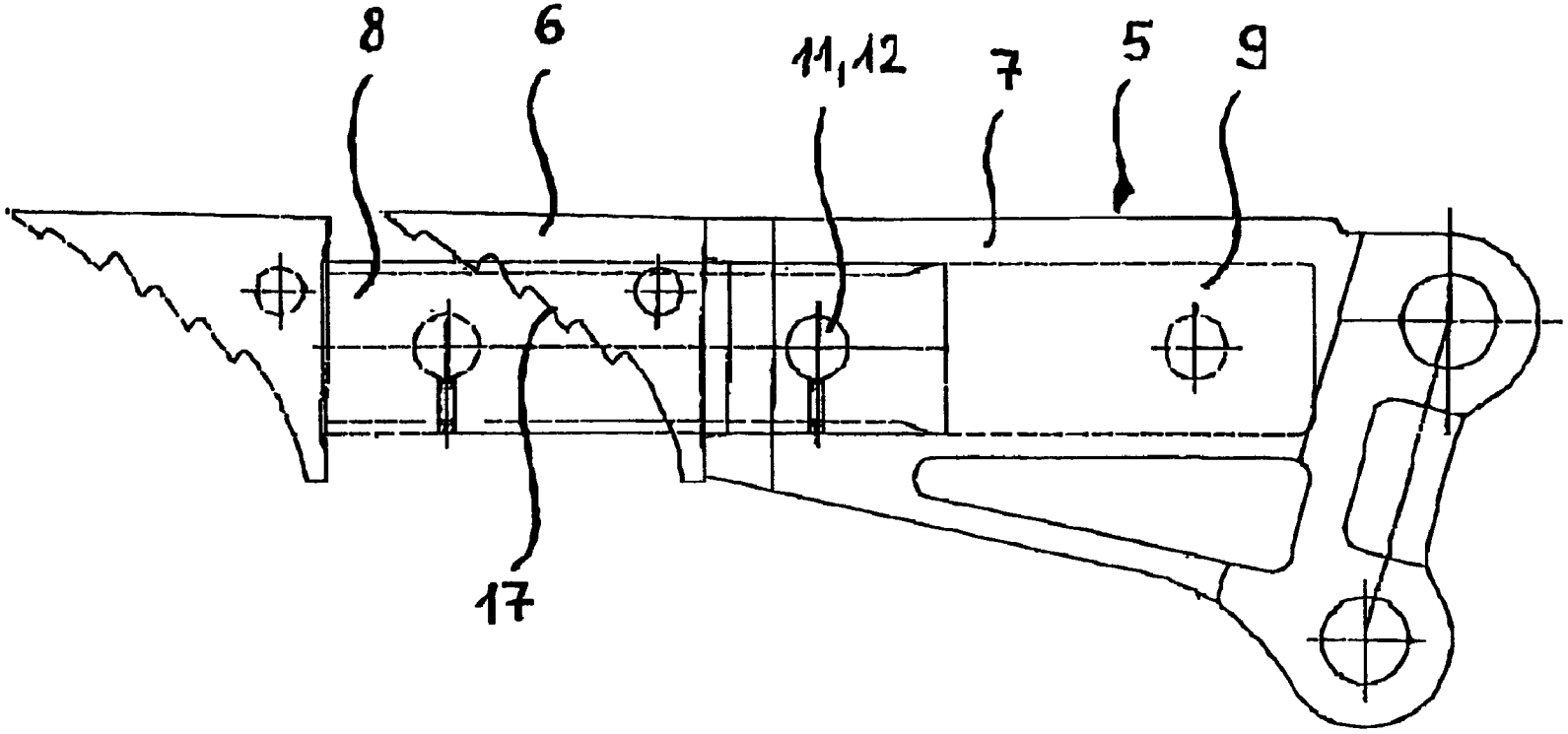
Figure 4:
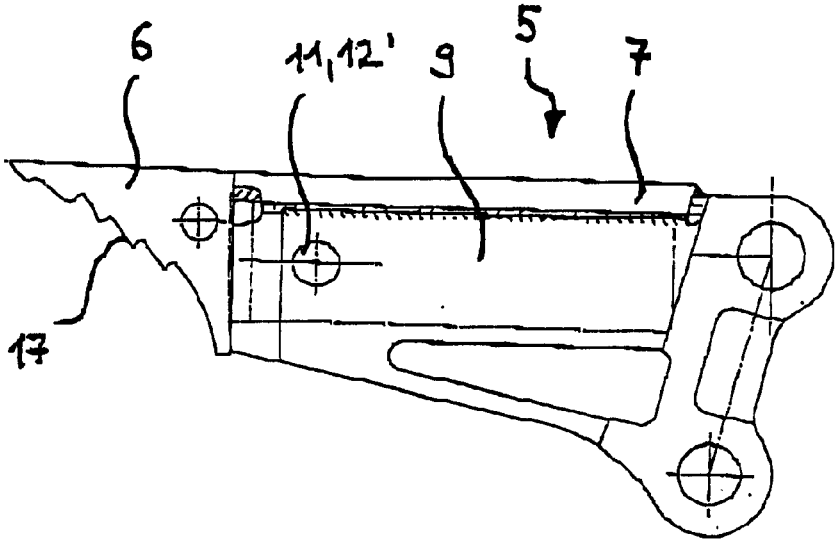
Figure 5:
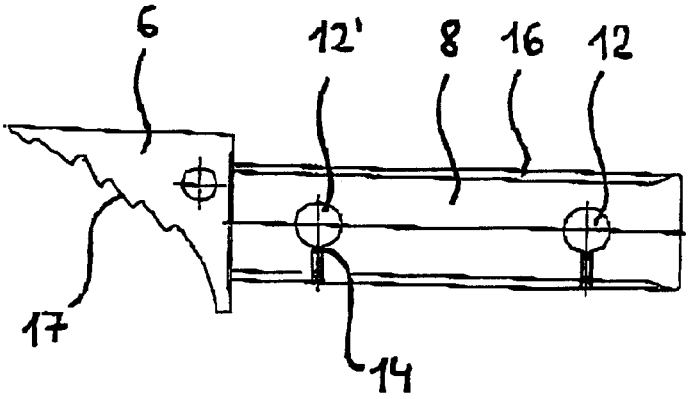
Figure 6:
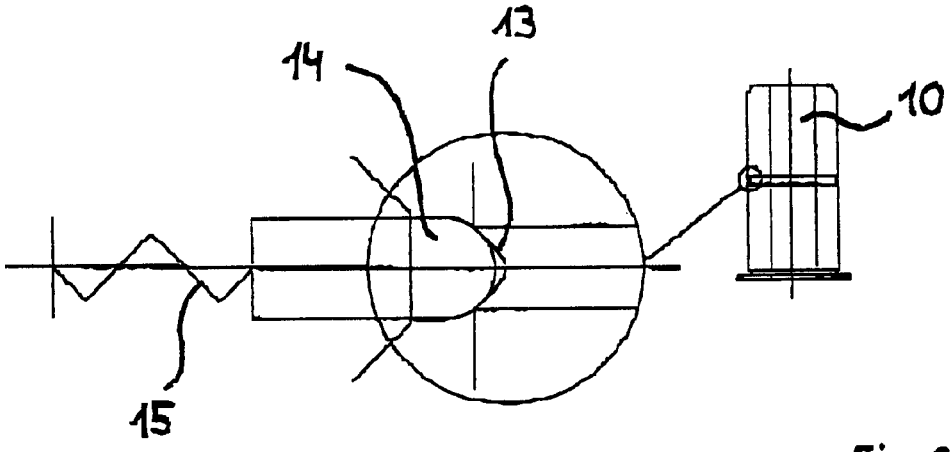

The invention is explained in greater detail with reference to an advantageous embodiment example in the drawn figures. These show:

FIG. 1: a plan view of the rescue apparatus in the closed as well as opened state of the tool halves, and showing, in each case, two different positions of the working tip;

FIG. 2: a plan view of the rescue apparatus according to FIG. 1 showing only one tool half in the closed as well as opened state, and in each case two different positions of the working tip;

FIG. 3: a plan view of a tool half showing two different positions of the longitudinally displaceable working tip;

FIG. 4: a plan view of the tool half according to FIG. 3 with pushed-in working tip;

FIG. 5: a plan view of the guide part with working tip;

FIG. 6: a plan view of the securing bolt as well as a detail view of the securing bolt in enlarged scale.

Reference numeral 1 identifies the rescue apparatus in its entirety. The rescue apparatus 1 displays a head component 2, on which two tool halves 4, 5 are swingably arranged by means of a coupling element 3. The tool halves 4, 5 display in each case a working tip 6, which, for example, in the closed position a can be pushed into the gap of a jammed automobile door and then swung outward into an open position b in order to spread open the automobile door. Since according to the type of application different opening widths as well as different forces are required, according to the invention provision is made for the attachment of the working tips 6 to the respective tool halves 4, 5 in a longitudinally displaceable manner. By this means it is possible to set different opening widths of the working tips 6, without requiring additional components or the replacement of the tool halves with tool halves of different opening widths of the working tips 6. The advantageous, portable unity of the rescue apparatus 1 is therefore preserved. FIG. 2 represents the rescue apparatus 1 with only one tool half 5 in the closed position a as well as in the opened position b for the purpose of greater clarity and understanding. In FIGS. 1, 2, and 3, the extended positions of the working tips 6 are reproduced in dashed lines.

The tool halves 4, 5 in each case include a holding part 7, at which a guide part 8, connected to the working tip 6, is arranged so as to be longitudinally displaceable. In the drawings, the guide part 8 can be fixed to the holding part 7 in two positions, in order that, even when the effect of forces is present, the set arm length and thus the desired opening width of the tool halves 4, 5 are maintained.

The holding part 7 displays a tunnel 9 (shown in dashed lines), into which the guide part 8 can be longitudinally slid. The tunnel 9, closed at the other end, represents at the same time a protective element for the flawless operation of the guide piece 8. Thus, the tunnel 9 protects against impurities, mechanical influences from the outside, and the like. The guide piece 8 can be fixed in a particular position relative to the holding part 7 by means of a securing bolt 10. The securing bolt 10 here penetrates, in the inserted state, a bore 11 in the holding part 7 as well as a bore 12 in the guide part 8. As can be seen in particular in FIG. 3, the bores 11, 12 are arranged one atop the other when the guide part 8 is in the extended position, so that the securing bolt 10 can be inserted through the bores in order to fix the position of the long tool arm. In addition, in the pushed-in state of the guide part 8 according to FIG. 4, the securing bolt 10 prevents an unintended arm extension of the tool half 5. The securing bolt 10 penetrates in this state the bore 11 of the holding part 7 as well as the bore 12' (see also FIG. 5) of the guide part 8.

The securing bolt 10, in the inserted state, ends flush with the surface of the holding part 7, so that the securing bolt does not protrude towards the outside in a manner that would be troublesome in operation.

In order to fix the securing bolt 10 in the inserted state, the bolt displays a laterally-arranged recess 13, into which penetrates a spring-loaded projection 14 arranged on the guide part 8. This "click into place" mechanism can be seen in particular in FIGS. 5 and 6. There, reference numeral 15 marks the spring that presses the projection 14 into the recess 13. The projection 14 has a spherical form and the recess 13 that of a semicircle, so that the projection 14 easily clicks into the recess 13. Likewise, by virtue of this round shape of the projection 14 as well as of the recess 13, the securing bolt 10 can be easily detached by hand. The recess 13 is designed around the entire periphery of the securing bolt 10, so that the latter can engage the projection 14 in any rotational position.

Advantageously, the securing bolt 10 is fastened, so that is cannot be lost, to the holding part 7 or to the head component 2 by means of a flexible connecting part (not shown in the drawings), in particular a chain, and is also thereby always ready for use by the person operating the rescue apparatus 1.

The guide part 8 further displays reinforced outer edges 16, which are guided in the grooves (not shown in detail in the figures) formed in the tunnel 9. Thereby, a stable longitudinal displaceability of the guide part 8, in particular at the highly-loaded outer edges 16, is ensured.

As shown in the drawings, the working tip 6 displays a sawtooth-shaped outer profile 17, which is of particular advantage in the application of the rescue apparatus 1 as a spreading apparatus. However, it is also possible to use the rescue apparatus 1 as a cutting apparatus and/or as a tractive apparatus, in which case the working tips 6 are designed accordingly.

What is claimed is:

1. Rescue apparatus comprising tool halves arranged swingably on a head component, each tool half having a working tip, wherein each working tip is attached to each respective tool half so as to be longitudinally displaceable so that an opening width in a swinging movement of the tool halves is adjustable.

2. Rescue apparatus according to claim 1, wherein at least one of the tool halves includes a holding part, at which a guide part, connected to the respective working tip, is arranged so as to be longitudinally displaceable.

3. Rescue apparatus according to claim 2, wherein the guide part can be fixed to the holding part in at least two positions.

4. Rescue apparatus according to claim 2, wherein the holding part displays a tunnel, inside which the ride part is longitudinally displaceable.

5. Rescue apparatus according to claim 2, wherein the guide part displays a tunnel, inside which the holding part is longitudinally displaceable.

6. Rescue apparatus according to claim 2, wherein the guide part can be fixed to the holding part in a particular position by means of at least one securing bolt.

7. Rescue apparatus according to claim 6, wherein the securing bolt, in an inserted state, penetrates a bore in the holding part as well as a bore in the guide part.

8. Rescue apparatus according to claim 6, wherein the securing bolt, in an inserted state, ends flush with a surface of the guide pan or of the holding part.

9. Rescue apparatus according to claim 6, wherein the securing bolt displays a laterally-arranged recess, into which penetrates a spring-loaded projection arranged on the holding part or on the guide part.

10. Rescue apparatus according to claim 9, wherein the projection has a spherical shape.

11. Rescue apparatus according to claim 9, wherein the recess has a semicircular shape.

12. Rescue apparatus according to claim 6, wherein the securing bolt is attached to the holding part or to the head component by means of a flexible connecting part.

13. Rescue apparatus according to claim 2, wherein the guide part has reinforced outer edges.

14. Rescue apparatus according to claim 13, wherein a tunnel of the guide part displays grooves extending in its longitudinal direction, in which grooves the outer edges are guided.

15. Rescue apparatus according to claim 1, wherein each working tip displays a sawtooth-shaped outer profile.

16. Rescue apparatus according to claim 1, wherein the rescue apparatus is configured to be used as a spreading apparatus or cutting apparatus or tractive apparatus.

* * * * *